US010223969B2

(12) United States Patent
Park et al.

(10) Patent No.: US 10,223,969 B2
(45) Date of Patent: Mar. 5, 2019

(54) ORGANIC LIGHT EMITTING DIODE DISPLAY

(71) Applicant: LG Display Co., Ltd., Seoul (KR)

(72) Inventors: Youngju Park, Seoul (KR); SungWook Yoon, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 143 days.

(21) Appl. No.: 15/277,827

(22) Filed: Sep. 27, 2016

(65) Prior Publication Data

US 2017/0092199 A1 Mar. 30, 2017

(30) Foreign Application Priority Data

Sep. 30, 2015 (KR) ..... 10-2015-0138251

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/3233* (2013.01); *G09G 3/3266* (2013.01); *G09G 3/3291* (2013.01); *G09G 2300/0426* (2013.01); *G09G 2300/0465* (2013.01); *G09G 2300/0809* (2013.01); *G09G 2300/0819* (2013.01); *G09G 2300/0852* (2013.01);
(Continued)

(58) Field of Classification Search
CPC .. G09G 3/3258; G09G 3/3233; G09G 3/3266; G09G 3/3291; G09G 2300/0426; G09G 2300/0465; G09G 2300/0809; G09G 2300/0819; G09G 2300/0852; G09G 2300/0861; G09G 2310/0216; G09G 2310/0286; G09G 2310/08; G09G 2320/045; G09G 2320/0233; G09G 2310/0251; G09G 2310/0262; G09G 2330/021; G09G 2300/0439; G09G 2310/0289
USPC ..... 345/691
See application file for complete search history.

(56) References Cited

U.S. PATENT DOCUMENTS

2013/0314308 A1* 11/2013 Hsu ..... G09G 3/3233 345/82
2014/0111557 A1 4/2014 Omata et al.

FOREIGN PATENT DOCUMENTS

CN 103150992 A 6/2013

OTHER PUBLICATIONS

European Extended Search Report, European Application No. 16191065.8, dated Jan. 30, 2017, 11 pages.

* cited by examiner

*Primary Examiner* — Claire X Pappas
*Assistant Examiner* — Ngan T Pham Lu
(74) *Attorney, Agent, or Firm* — Fenwick & West LLP

(57) ABSTRACT

Disclosed is an organic light emitting diode (OLED) display including a plurality of pixels, first and second scan signal stages, and emission control signal stages. The pixels are respectively arranged along n number of lines (n is a natural number), and each of the pixels include a first scan transistor, a driving transistor, a second scan transistor, and an emission control transistor. The first scan signal stages output first scan signals sequentially to the first scan transistors. The second scan signal stages output second scan signals sequentially to the second scan transistors. The emission control signal stages output emission control signals having a same phase to emission control transistors of two adjacent horizontal lines.

19 Claims, 10 Drawing Sheets

(51) Int. Cl.
*G09G 3/3291* (2016.01)
*G09G 3/3233* (2016.01)

(52) U.S. Cl.
CPC ..... *G09G 2300/0861* (2013.01); *G09G 2310/0216* (2013.01); *G09G 2310/0286* (2013.01); *G09G 2310/08* (2013.01); *G09G 2320/045* (2013.01)

ORGANIC LIGHT EMITTING DIODE DISPLAY

CROSS-REFERENCE TO RELATED APPLICATIONS

This application claims the benefit of Korea Patent Application No. 10-2015-0138251 filed on Sep. 30, 2015, the entire contents of which is incorporated herein by reference for all purposes as if fully set forth herein.

BACKGROUND

Field of Technology

The present disclosure relates to an organic light emitting diode (OLED) display.

Discussion of the Related Art

A flat panel display (FPD) is widely used for a desktop monitor, a laptop, a personal distal assistant (PDA), and any other mobile computer or mobile phone terminal, because the FPD is effective in achieving miniaturization and lightness. The FPD includes a liquid crystal display (LCD), a plasma display panel (PDP), a field emission display (FED), and an organic light emitting diode (OLED) display.

The OLED display has a fast response speed and a wide viewing angle, and is able to produce brightness with high luminous efficiency. Generally, an OLED display uses a scan transistor, which is turned on by a scan signal, to apply a data voltage to a gate electrode of a driving transistor, and enables an OLED to emit light using the data voltage supplied the driving transistor. In addition, the OLED display uses an emission control signal to perform switching of the driving transistor and a high-potential voltage input terminal.

Driving circuits generating a scan signal and an emission control signal may be formed in a bezel area of a display panel by using a gate in panel (GIP) scheme. Recently, methods for reducing the bezel area have been studied to satisfy user demands. However, it is difficult to reduce the size of the bezel area because of a GIP circuit.

SUMMARY

An organic light emitting diode (OLED) display according to the present disclosure includes a plurality of pixels respectively arranged along n number of horizontal lines in a first direction where (n indicates is a natural number), each of the plurality of pixels and comprising a first scan transistor connected to a gate electrode of a driving transistor, a second scan transistor connected to a source first electrode of the driving transistor, and an emission control transistor connected to a drain second electrode of the driving transistor; n number of first scan signal stages that output first scan signals sequentially to the first scan transistors arranged along the n number of lines; and $$\frac{n}{2}$$

number of emission control signal stages that output emission control signals that have a same phase, a same emission control signal outputted to emission control transistors of two adjacent lines.

In another embodiment an organic light emitting diode (OLED) display comprises: a first row of pixels and a second row of pixels that is adjacent to the first row of pixels, each pixel comprising an OLED, a driving transistor connected to the OLED, and an emission control transistor connected to the driving transistor; and an emission control stage connected to both the first row of pixels and the second row of pixels, the emission control stage outputting an emission control signal to a gate electrode of each emission control transistor included in both the first row of pixels and the second row of pixels.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
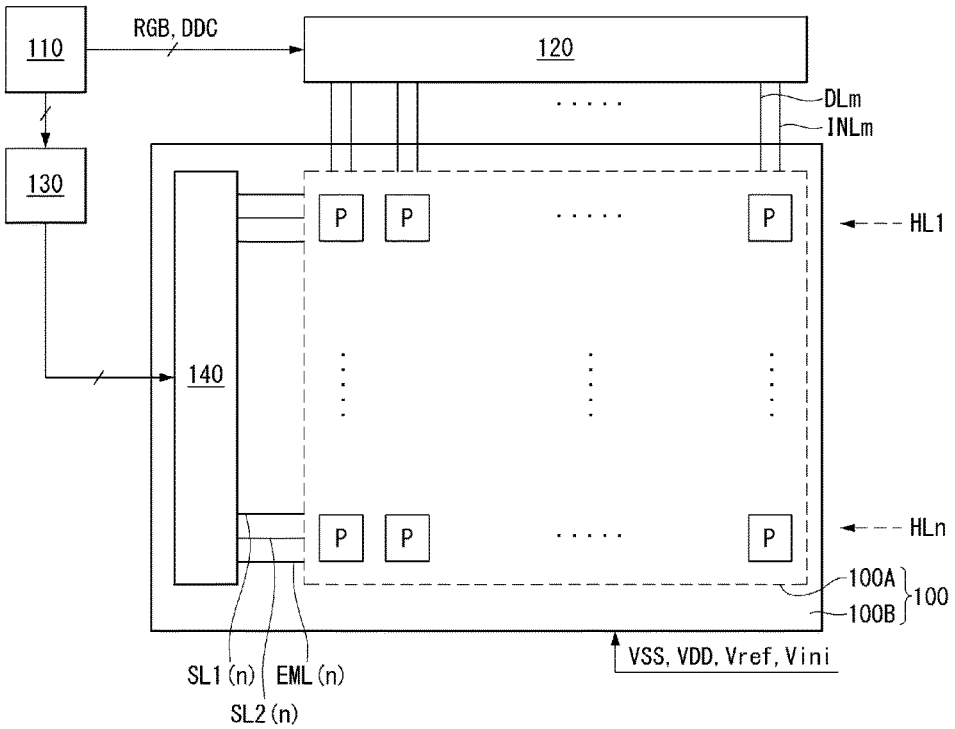
FIG. 1 is a diagram illustrating an Organic Light Emitting Diode (OLED) display according to an embodiment of the present disclosure.

Hereinafter, the embodiments disclosed in the present specification will be described in detail with reference to the accompanying drawings, and the same or similar elements are denoted by the same reference numerals even though they are depicted in different drawings and redundant descriptions thereof will be omitted.

FIG. 1 is an organic light emitting diode (OLED) display according to an embodiment of the present disclosure.

Referring to FIG. 1, the OLED display according an embodiment of the present disclosure includes a display panel 100 in which pixels P are arranged in a matrix, a data driver 120, a gate driver including a level shifter 130 and a shift register 140, and a timing controller 110.

The display panel 100 includes a display portion 100A in which the pixels P are arranged to display an image, and a non-display portion 100B in which a shift register 140 is arranged and which does not display an image.

A plurality of pixels P is included, and an image is displayed based on gray scales displayed by the pixels P. The pixels P are arranged along the first horizontal line HL1 to a n-the horizontal line HL[n].

Each of the pixels P is connected to an initialization line INL and a data lines which are arranged along a column line, and connected to a first scan line SL1, a second scan line SL2, and an emission control signal line EML which are arranged along a horizontal line HL. In addition, each of the pixels P includes an OLED, a driving transistor DT, a first scan transistor ST1, a second scan transistor ST2, an emission control transistor ET, a storage capacitor Cst, and a sub-capacitor Csub. Each of the transistors DT, ST1, ST2, and ET may be implemented as a thin film transistor (TFT) including a polycrystalline semiconductor layer according to one embodiment. However, aspects of the present disclosure are not limited thereto, and the semiconductor layer of the TFT may be formed of an amorphous silicon semiconductor or an oxide semiconductor.

The timing controller 110 is configured to control operation timing of the data driver 120, the gate driver. To this end, the timing controller 110 realigns externally received digital video data RGB to fit the resolution of the display panel 100, and supplies the realigned digital video data RGB to the data driver 120. In addition, the timing controller 110 generates a control signal DDC for controlling operation timing of the data driver 120, and a gate control signal GDC for controlling operation timing of the gate driver, based on timing signals such as a vertical synchronizing signal Vsync, a horizontal synchronizing signal Hsync, a dot clock signal DCLK, and a data enable signal DE.

The data driver 120 is configured to drive data lines DL. To this end, the data driver 120 converts digital video data RGB received from the timing controller 110 into an analog data voltage based on the data control signal DDC, and supplies the analog data voltage to the data lines DL. In addition, the data driver 120 supplies an initialization voltage Vini to the pixels P through an initialization line INL.

The gate driver includes a level shifter 130 and a shift register 140. The level shifter 130 is formed as an integrated circuit (IC) on a printed circuit board (PCB) (now shown) connected to the display panel 100. The shift register 140 is formed on the non-display portion 100B of the display panel 100 by using a gate in panel (GIP) scheme.

The level shifter 130 performs level shifting of the clock signals CLK and a start signal VST under the control of the timing control, and supplies the level-shifted clock signals CLK and the level-shifted start signal VST. The shift register 140 is formed as a combination of multiple TFTs in the non-display portion 100B of the display panel 100 by using the GIP scheme. The shift register 140 is comprised of stages which shift scan signals and output the shifted scan signal in response to the clock signals CLK and the start signal VST. The stages included in the shift register 140 output first scan signals SCAN1, second scan signals SCAN2, and emission control signal EM.

Figure 2:
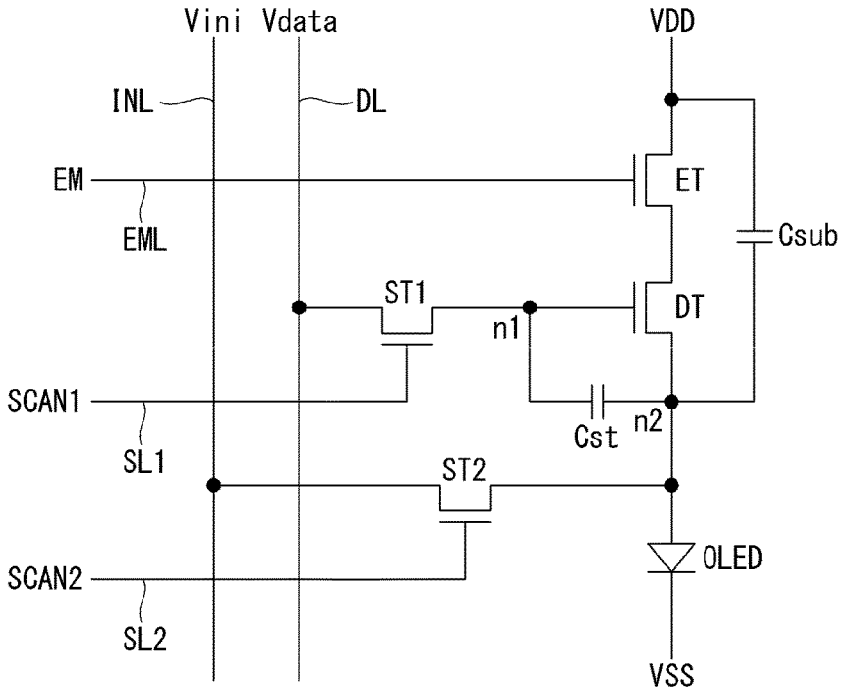
FIG. 2 is a diagram illustrating the structure of a pixel shown in FIG. 1 according to an embodiment of the present disclosure.

FIG. 2 shows an example of a pixel P shown in FIG. 1 according to one embodiment.

Referring to FIG. 2, the pixel P according to an embodiment of the present disclosure includes an OLED, a driving transistor DT, a first scan transistor ST1, a second scan transistor ST2, an emission control transistor ET, a storage capacitor Cst, and a sub-capacitor Csub.

The OLED emits light by a driving current supplied from the driving transistor DT. Multiple organic compound layers are formed between an anode electrode and a cathode electrode of the OLED. The organic compound layers include hole injection layers (HIL), hole transport layers (HTL), emission layers (EML), electron transport layers (ETL), and electron injection layers (EIL). The anode electrode of the OLED is connected to a source electrode of the driving transistor DT, and the cathode electrode of the OLED is connected to GVSS.

The driving transistor DT uses its gate-source voltage to control a driving current which is to be applied to the OLED. To this end, the driving transistor DT includes a gate electrode connected to an input terminal of a data voltage Vdata, a drain voltage connected to an input terminal of a driving voltage VDD, and a source electrode connected to a low-potential driving voltage VSS.

In response to a first scan signal, the first scan transistor ST1 applies a reference voltage Vref or a data voltage Vdata, which is received from the data line DL, to the gate electrode of the driving transistor DT. To this end, the first scan transistor ST1 includes a gate electrode connected to the first scan line SL1, a drain electrode connected to the data line DL, and a source electrode connected to a first node n1.

In response to a second scan signal SCAN2, the second scan transistor ST2 provides an initialization voltage Vini, which is received from the initialization line INL, to a second node n2. To this end, the second scan transistor ST2 includes a gate electrode connected to the second scan line SL2, a drain electrode connected to the initialization line INL, and a source electrode connected to the second node n2.

In response to an emission control signal, the emission control transistor ET controls a current path between the input terminal of the driving voltage VDD and the driving transistor DT. To this end, the emission control transistor ET includes a gate electrode connected to the emission control signal line EML, a drain electrode connected to the input terminal of the driving voltage VDD, and a source electrode connected to the driving transistor DT.

The storage capacitor Cst maintains the data voltage Vdata, which is received from the data line DL, for one frame, so that the driving transistor DT can maintain a constant voltage. To this end, the storage capacitor Cst is connected to the gate electrode and the source electrode of the driving transistor DT.

The sub-capacitor Csub is connected in series to the storage capacitor Cst at the second node n2 so as to adjust efficiency of the driving voltage Vdata.

Figure 3:
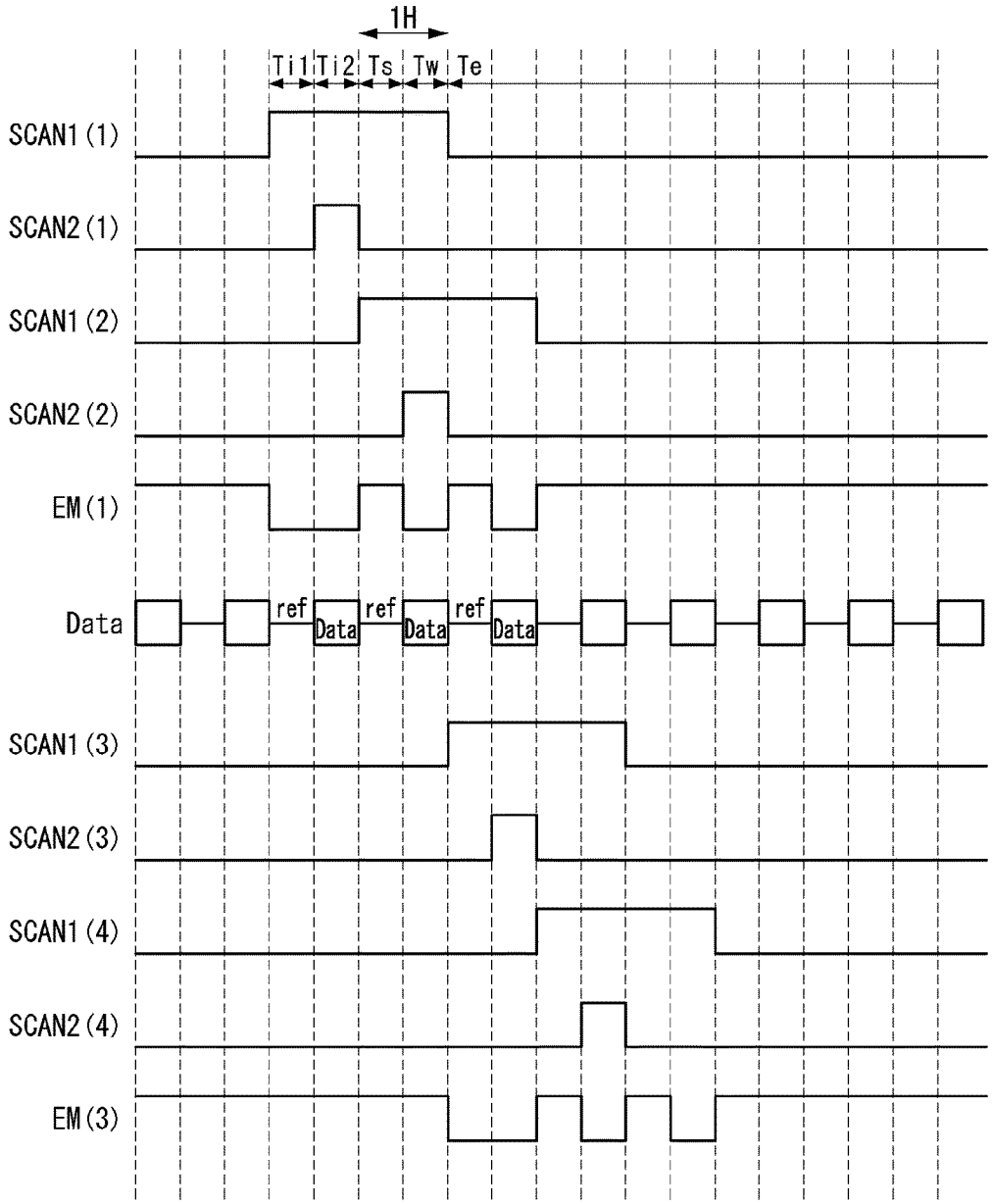
FIG. 3 is a diagram illustrating timing of control signals applied to the pixel shown in FIG. 2 according to an embodiment of the present disclosure.

Operation of the pixel P in the above-described structure is described in the following. FIG. 3 is a waveform diagram showing signals EM, SCAN, INIT, and DATA applied to the pixel P shown in FIG. 2 according to one embodiment.

In the drawings, one horizontal period H indicates a scanning period of pixels arranged along one horizontal line HL. The scanning period includes a sampling period and a data writing period.

FIGS. 4A to 4D are equivalent circuits of a pixel P in an initialization period Ti, a sampling period Ts, a data writing period Tw, and an emission period Te. In FIGS. 4A to 4D, a solid line indicates each activated element or current path, and a dotted line indicates each inactivated element or current path. FIGS. 4A to 4D show operation of pixels P that are arranged, for example, along one horizontal line according to one embodiment.

Operation of each pixel P according to an embodiment of the present disclosure includes: an initialization period Ti for initializing the first node n1 and the second node n2 to a specific voltage; a sampling period Ts for detecting a threshold voltage of the driving transistor DT; a data writing period Tw for writing a data voltage; and an emission period Te for emitting light by compensating for a driving current applied to an OLED, regardless of a threshold voltage.

Figure 4A:
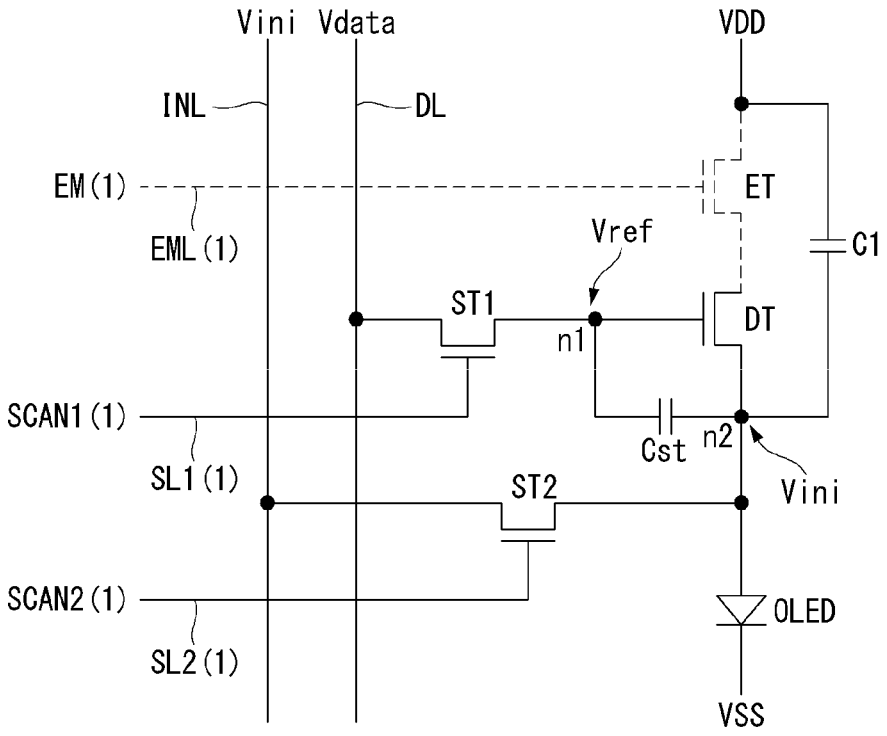
FIGS. 4A to 4D are diagrams illustrating a method of driving an OLED display according to an embodiment of the present disclosure.

Referring to FIGS. 3 and 4A, the initialization period Ti includes a first initialization period Ti1 and a second initialization period Ti2. In the first and second initialization periods Ti1 and Ti2, the first scan signal SCAN1 is applied at the turn-on voltage level. In the second initialization period Ti2, the second scan signal SCAN2 is applied at the turn-on voltage level. In the first and second initialization period Ti1 and Ti2, the emission control signal EM is applied at the turn-off voltage level.

When the second scan signal SCAN2 is at a turn-on voltage level, the second scan transistor ST2 applies an initialization voltage Vini, which is received from the initialization line INL, to the second node n2. As a result, a source voltage Vs of the driving transistor DT acts as the initialization voltage Vini. When the first scan signal SCAN1 is at the turn-on voltage level, the first scan transistor ST1 applies a reference voltage Vref, which is received from the data line DL, to the first node n1. As a result, a gate voltage Vg of the driving transistor DT acts as the reference voltage Vref.

The initialization voltage Vini is applied to the second node n2 in the initialization period T2 in an effort to initialize a concerned pixel to a specific level. In this case, the initialization voltage Vini is set to be smaller than an operation voltage of the OLED to prevent the OLED from emitting light.

Figure 4B:
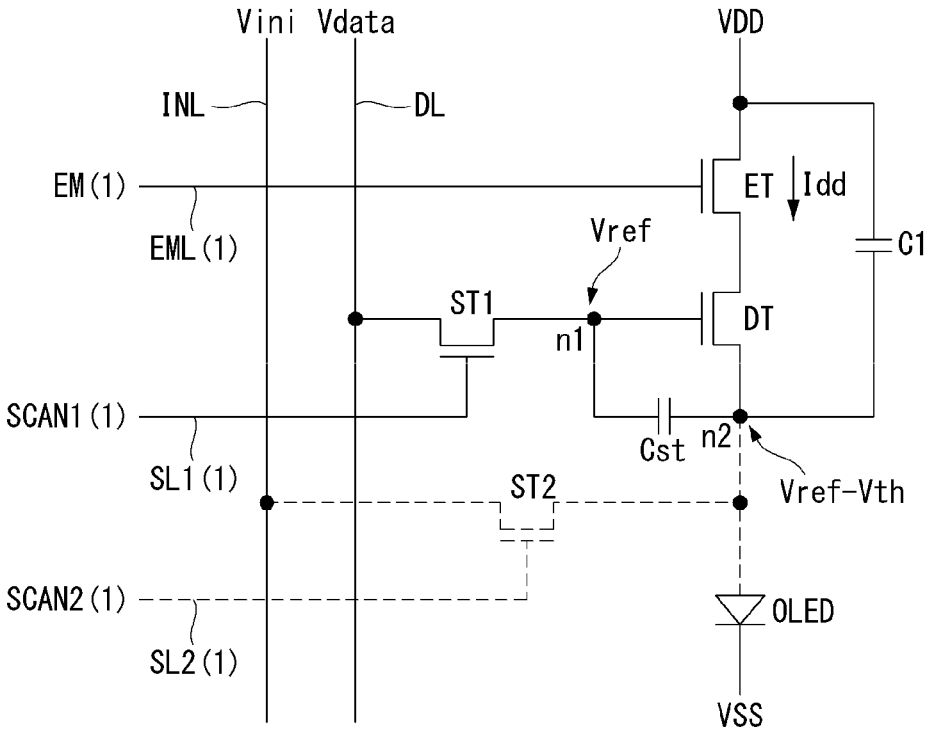

Referring to FIGS. 3 and 4B, in the sampling period Ts, the second scan signal SCAN2 is reversed to the turn-off voltage level, the emission control signal EM is reversed to the turn-on voltage level, and the first scan signal SCAN1 remains at the turn-on voltage level.

In response to the first scan signal SCAN1, the first scan transistor ST1 applies the reference voltage Vref, which is received from the data line DL, to the first node n1. In response to the emission control signal EM, the emission control transistor ET applies a driving voltage VDD to the driving transistor DT.

When the second node n2 is floating as a result of the second scan transistor ST2 being turned off, a voltage of the second node n2 gradually increases due to a current flowing from the drain electrode of the driving transistor DT to the source electrode thereof. In this case, the first node n1 remains at the reference voltage Vref, so the second node n2 is saturated with a voltage which corresponds to difference between the reference voltage Vref and the threshold voltage Vth of the driving transistor DT. That is, in the sampling period Ts, a gate-source potential difference of the driving transistor DT is equal to that of the threshold voltage Vth.

Figure 4C:
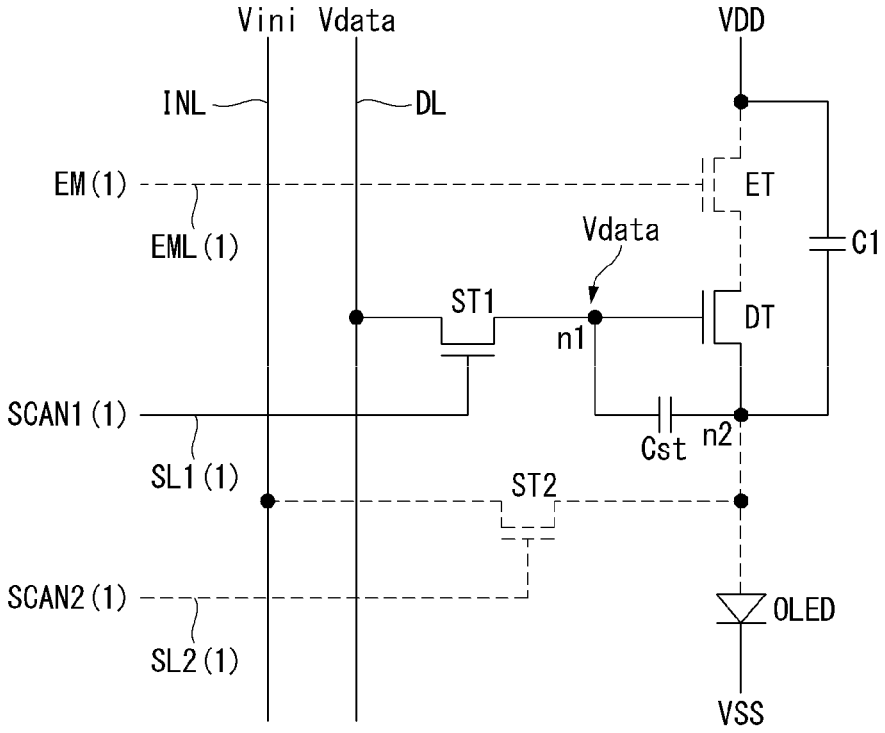

Referring to FIGS. 3 and 4C, in the data writing period Tw, the first scan signal SCAN1 remains at the turn-on voltage level, the second scan signal SCAN2 remains at the turn-off voltage level, and the emission control signal EM is reversed to the turn-off voltage level.

In response to the first scan signal SCAN1, the first scan transistor ST1 supplies a data voltage Vdata, which is received from the data line DL, to the first node n1. At this point, a voltage of the second node n2 in a floating state rises or falls because coupling effects occur due to the ratio of capacitance between the storage capacitor Cst to a sub-capacitor C1.

Figure 4D:
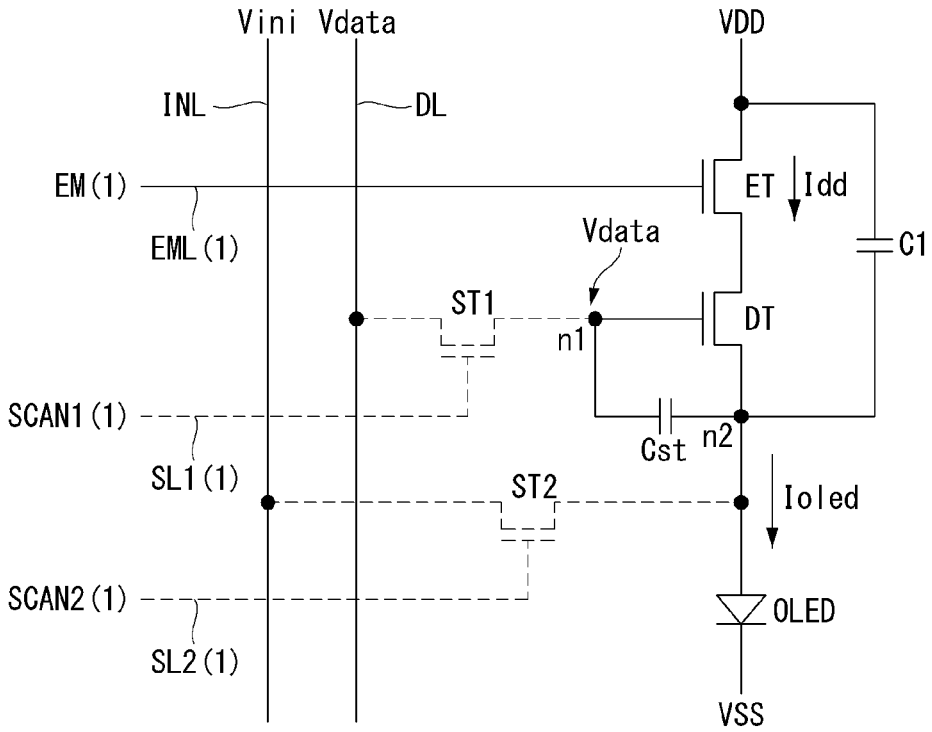

Referring to FIGS. 3 and 4D, in the emission period Te, the first scan signal SCAN1 is reversed to the turn-off voltage level, the second scan signal SCAN2 remains at the turn-off voltage level, and the emission control signal EM is reversed to the turn-on voltage level.

In the emission period Te, the data voltage Vdata stored in the storage capacitor Cst is supplied to the OLED, so the OLED emits light with brightness which is in proportion to the data voltage Vdata. At this point, current flows in the driving transistor DT by the voltages of the first and second nodes n1 and n2 determined in the data writing period Tw, so a desired current is supplied to the OLED. As a result, the OLED is able to control brightness using the data voltage Vdata.

Figure 5:
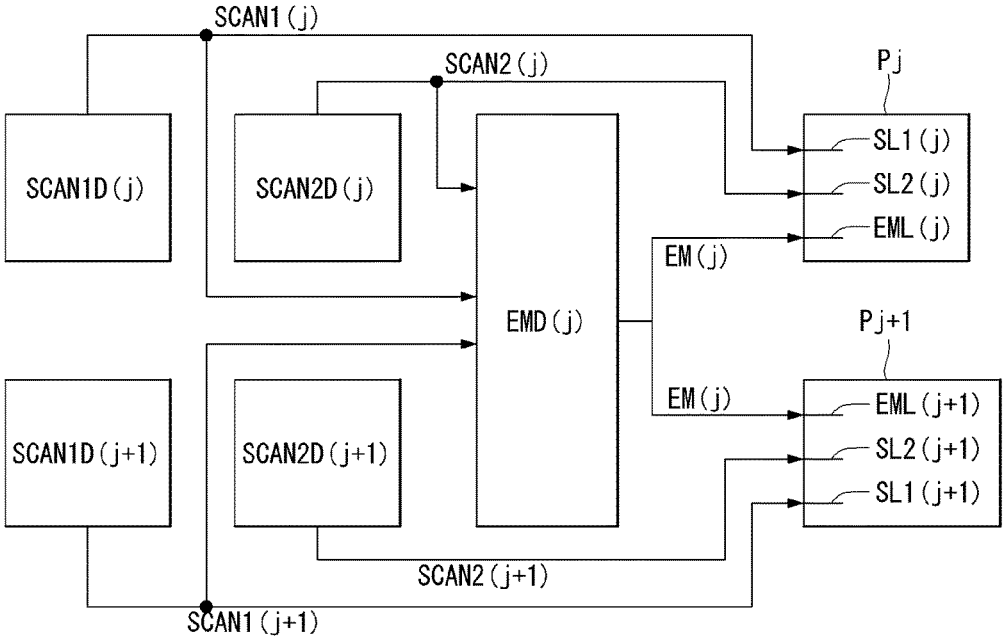
FIG. 5 is a diagram illustrating stages of a shift register according to an embodiment of the present disclosure.

FIG. 5 is a diagram illustrating stages of the shift register 140. FIG. 5 shows stages that are connected to pixels arranged along a j-th horizontal line and a (j+1)-th horizontal line (j is an odd number smaller than n)

Referring to FIG. 5, stages for driving pixels arranged along a pair of two adjacent horizontal lines HLj and HL[j+1] include a j-th first scan signal stage SCAN1D[j], a j-th second scan signal stage SCAN2D[j], a (j+1)-th first scan signal stage SCAN1D[j+1], a (j+1)-th second scan signal stage SCAN2D[j+1], and a j-th emission control signal stage EMD[j].

The j-th first scan signal stage SCAN1D[j] generates a j-th first scan signal SCAN1[*j*], and applies the j-th first scan signal SCAN1 to a j-th first scan line SL1[*j*].

The j-th second scan signal stage SCAN2D[*j*] generates a j-th second scan signal SCAN2[*j*], and applies the j-th second scan signal SCAN2[*j*] to a j-th second scan line SL2[*j*].

The (j+1)-th first scan signal stage SCAN1D[j+1] generates a (j+1)-th first scan signal SCAN1[*j*+1], and applies the (j+1)-th first scan signal SCAN1[*j*+1] to a (j+1)-th first scan line SL1[*j*+1].

The (j+1)-th second scan signal stage SCAN2D[j+1] generates a (j+1)-th second scan signal SCAN2[*j*+1], and applies the (j+1)-th second scan signal SCAN2[*j*+1] to a (j+1)-th second scan line SL2[*j*+1].

The j-th emission control signal stage EMD[j] generates a j-th emission control signal EM[j], and applies the j-th emission control signal EM[j] to a j-th emission control signal line EML[j] connected to pixels Pj arranged along the j-th horizontal line and a (j+1)-th emission control signal line EML[j+1] connected to pixels P[j+1] arranged along the (j+1)-th horizontal line. The j-th emission control signal stage EMD[j] is used as a clock signal for controlling operation timing of each transistor by receiving a j-th first scan signal SCAN1, a j-th second scan signal SCAN2, and a (j+1)-th first scan signal SCAN1.

Pixels arranged along a pair of two adjacent horizontal lines are driven by the same emission control signal, so it is possible to drive pixels arranged along n number of horizontal lines with n/2 number of emission control signal stages. That is, it is possible to reduce the entire area of the shift register 140, and thus, reduce a bezel area of the non-display portion 100B.

Figure 6:
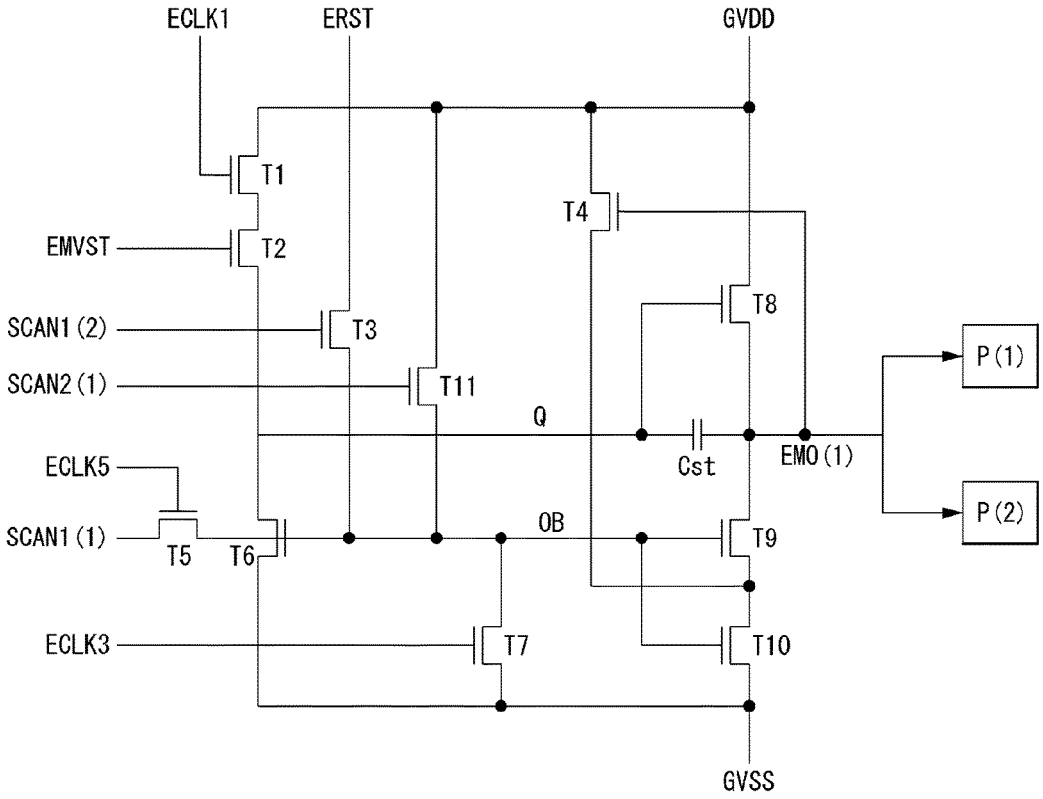
FIG. 6 is a circuit diagram illustrating an emission control signal stage according to an embodiment of the present disclosure.

FIG. 6 is a circuit diagram illustrating an emission control signal stage of the shift register 140 according to one embodiment. In particular, it shows an emission control signal stage EMD1 that outputs a first emission control signal EM1 which is supplied to pixels arranged along a first horizontal line HL1 and a second horizontal line HL2.

Figure 7:
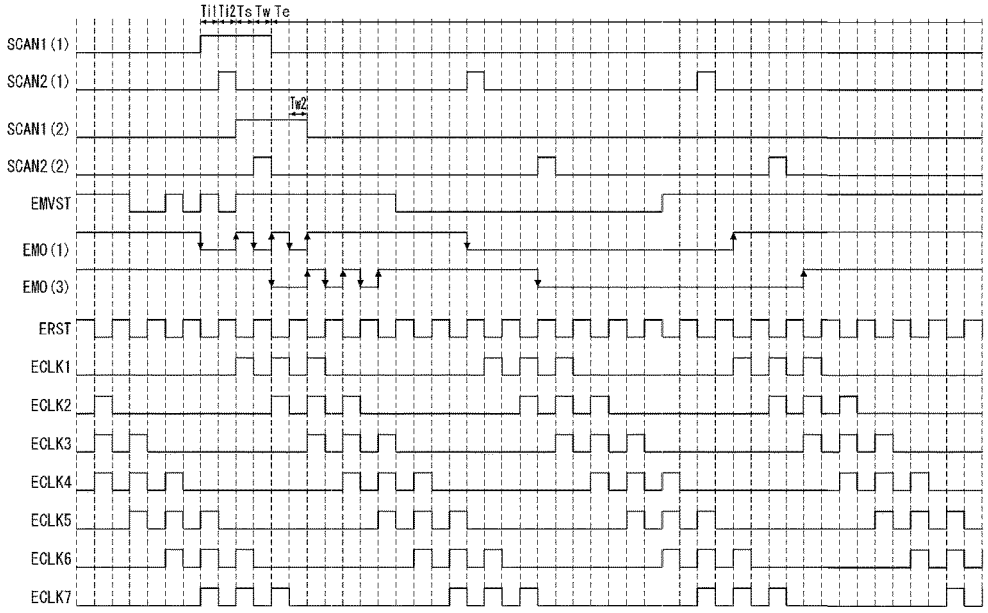
FIG. 7 is a timing diagram illustrating input and output signals in the emission control signal stage shown in FIG. 6.

Referring to FIGS. 6 and 7, an emission control signal stage EMD1 of the first stage generates a first emission control signal EM1 by using a first instance of a first scan signal SCAN1[1], a first instance of a second scan signal SCAN2[1], a first emission clock ECLK1, a third emission clock ECLK3, a fifth emission clock ECLK5, a start signal EMVST, and a reset signal ERST. The first instance of the first scan signal SCAN1[1] and the first instance of the second scan signal SCAN2[1] respectively indicate the first scan signal SCAN1[1] and the second scan signal SCAN2[1], which are output by the first and second scan signal stages SCAN1D[1] and SCAN2D[1] of the first stage. The second instance of the first scan signal SCAN1[2] indicates a first scan signal SCAN1[2] output by the first scan signal stage SCAN1D[2] of the second stage.

Similarly, instead of the first emission clock ECLK1, the third emission clock ECLK3, and the fifth emission clock ECLK5, the j-th emission control signal stage EMD[j]

receives a j-th emission clock ECLKj, a (j+2)-th emission clock ECLK[j+2], and a (j+4)-th emission clock ECLK[j+4].

The emission clock ECLK comprises seven phases, and each clock signal is continuous. Thus, for a clock signal having (j+k) which is greater than 7 (k indicates a natural number satisfying the condition of 1<k<7), a clock signal with an ordinal number obtained by subtracting 7 from (j+k) is used. For example, a (j+4)-th gate clock GCLK[j+4] in the fifth emission control signal stage corresponds to a second gate clock GCLK2.

The first transistor T1 includes a first electrode connected to an input terminal of the high-potential voltage GVDD, a second electrode connected to a first electrode of a second transistor T2, and a gate electrode connected to an input terminal of the first emission clock ECLK1. The second transistor T2 includes the first electrode connected to the second electrode of the first transistor T1, a second electrode connected to a Q node (Q), and a gate electrode connected to an input terminal of the start signal EMVST. When the emission clock ECLK1 and the start signal EMVST are synchronized, the first and second transistors T1 and T2 are all turned on, and accordingly, the Q node (Q) is charged to the high-potential voltage GVDD provided through the first and second transistors T1 and T2.

A first low-potential trigger transistor T5 include a first electrode connected to an output terminal of the first instance of the first scan signal SCAN1[1], a second electrode connected to a QB node (QB), and a gate electrode connected to the input terminal of the fifth emission clock ECLK5. Accordingly, when the fifth emission clock ECLK5 and the first instance of the first scan signal SCAN1 [1] are synchronized, the first low-potential trigger transistor T5 charges the QB node (QB).

A second low-potential trigger transistor T3 includes a first electrode connected to an input terminal of the emission reset signal ERST, a second electrode connected to the QB node (QB), and a gate electrode connected to an output terminal of the second instance of the first scan signal SCAN1[2]. Accordingly, when the emission reset signal ERST and the second first scan signal SCAN1 [2] are synchronized, the second low-potential trigger transistor T3 charges the QB node (QB).

A third low-potential trigger transistor T11 includes a first electrode connected to an input terminal of the high-potential voltage GVDD, a second electrode connected to the QB node (QB), and a gate electrode connected to the output terminal of the first instance of the second scan signal SCAN2[1]. Accordingly, when the first instance of the second scan signal SCAN2[1] is applied, the third low-potential trigger transistor T11 charges the QB node (QB).

A fourth transistor T4 includes a first electrode connected to a high-potential voltage GVDD, a second electrode connected to a second electrode of a ninth transistor T9 and a gate electrode connected to an emission control signal output terminal EMO(1).

The sixth transistor T6 includes a first electrode connected to the Q node (Q), a second electrode connected to an input terminal of the low-potential voltage GVSS, and a gate electrode connected to the QB node (QB). Accordingly, when the QB node (QB) is charged, the sixth transistor T6 discharges the Q node (Q) to the low-potential voltage GVSS.

A seventh transistor T7 includes a first electrode connected to the QB node (QB), a second electrode connected to the low-potential voltage GVSS, a gate electrode connected to an input terminal of the third emission clock ECLK3. Accordingly, the seventh transistor T7 discharges the QB node (QB) in response to the third emission clock ECLK3.

A pull-up transistor T8 includes a first electrode connected to the high-potential voltage GVDD, a second electrode connected to an emission control signal output terminal EMO(1), a gate electrode connected to the Q node (Q). Accordingly, when the Q node (Q) is charged, the pull-up transistor T8 is turned on and subsequently generates a first emission control signal EM1 at the level of the high-potential voltage GVDD to the emission control signal output terminal EMO1.

Pull-down transistors T9 and T10 are connected in series to each other. Each of the pull-down transistors T9 and T10 includes a gate electrode connected to the QB node (QB). A first electrode of the ninth transistor T9 is connected to the emission control signal output terminal EMO(1), and a second electrode of the tenth transistor T10 is connected to the low-potential voltage GVSS. Accordingly, the pull-down transistors T9 and T10 discharges the potential of the emission control signal output terminal EMO(1) to the low-potential voltage GVSS in response to the potential of the QB node (QB).

FIG. 7 is a diagram illustrating timing of clocks and control signals input to the emission control signal stage according to one embodiment. Referring to FIGS. 6 and 7, there are provided descriptions about a process in which the first emission control signal stage EMD1 outputs the first emission control signal EM1.

During a first initialization period Ti1, the first instance of the first scan signal SCAN1[1] and a fifth emission clock ECLK5 are synchronized. As a result, the first low-potential trigger transistor T5 is turned on, thereby charging the QB node (QB) to a voltage of the first instance of the first scan signal SCAN1[1]. The pull-down transistors T9 and T10 are turned on as a result of the QB node (QB) being charged, and the emission control signal output terminal EMO(1) is discharged to the low-potential voltage GVSS. As a result, an emission control signal, which was output at a high-level voltage in an emission period of a previous frame, is reversed to low level at the beginning of the first initialization period Ti1.

In the sampling period Ts, a first emission clock ECLK1 and a start signal EMVST are synchronized. The first transistor T1 is turned on by the first emission clock ECLK1, and the second transistor T2 is turned on by the start signal EMVST. As the first and second transistors T1 and T2 are turned on at the same time, the Q node (Q) and a boosting capacitor C are charged to the high-potential voltage GVDD bypassing the first and second transistors T1 and T2. The pull-up transistor T8 is turned on as a result of the Q node (Q) being charged, and the first emission control signal EM1 at the level of the high-potential voltage GVDD is output to the emission control signal output terminal EMO1.

In the data writing period Tw, the first scan signal SCAN1 of the second stage and a reset signal ERST are synchronized. As a result, the second low-potential trigger transistor T3 is turned on, thereby charging the QB node (QB) using the reset signal ERST. The pull-down transistors T9 and T10 are turned on as a result of the QB node (QB) being charged, and the emission control signal output terminal EMO(1) is discharged to the low-potential voltage GVSS.

At the beginning of the emission period Te, a first emission clock ECLK1 and the start signal EMVST are synchronized. The first transistor T1 is turned on by the first emission clock ECLK1, and the second transistor T2 is turned on by the start signal EMVST. As the first and second transistors T1 and T2 are turned on at the same time, the Q node (Q) and the boosting capacitor C are charged to the high-potential voltage GVDD bypassing the first and second transistors T1 and T2. The pull-up transistor T8 is turned on as a result of the Q node (Q) being charged, and the first emission control signal EM1 at the level of the high-potential voltage GVDD is output to the emission control signal output terminal EMO(1).

In the emission period Te, the seventh transistor T7 is turned on at a specific interval in response to a third emission clock ECLK3. In a turn-on state, the seventh transistor T7 maintains the QB node (QB) at low-potential voltage in order to restrain the pull-down transistors T9 and T10 from turning on. That is, the seventh transistor T7 enables the first emission control signal EM1 to be stably output through the emission control signal output terminal EMO(1) in the emission period Te.

In the emission period Te, the eleventh transistor T11 is turned on by the first instance of the second scan signal SCAN2[1]. When the eleventh transistor T11 is turned on, the QB node (QB) is charged, thereby rendering the pull-down transistors T9 and T10 turned on. The pull-down transistors T9 and T10 are turned on, thereby discharging the voltage of the emission control signal output terminal EMO (1). That is, the first instance of the second scan signal SCAN2[1] applied in the emission period Te stops outputting of the first emission control signal EM1. The voltage of the emission control signal output terminal EMO(1), which is discharged by the first instance of the second scan signal SCAN2[1], is maintained to be a low-potential voltage until the first emission clock ECLK1 and the start signal EMVST are synchronized.

As such, the emission period Te is divided into a period of outputting the emission control signal EM and a period of suppressing the emission control signal EM, so it is possible to drive pixels at duty cycles.

The first emission control signal EM1 according to the present disclosure is applied at the same time not just to pixels arranged along the first horizontal line HL1, but to pixels arranged along the second horizontal line HL2. Thus, the first emission control signal EM1 has to satisfy driving requirements not just of the pixels arranged along the first horizontal line HL1, but of the pixels arranged along the second horizontal line HL2. The second data writing period Tw2 of the pixels arranged along the second horizontal line corresponds to a specific part of the emission period Te of the pixels arranged along the first horizontal line HL1. In the data writing period Tw of the pixels arranged along the second horizontal line HL2, the second first scan signal SCAN1[2] and the reset signal ERST turn off the second low-potential trigger transistor T3. That is, the first emission control signal EM1 may drive not just the pixels arranged along the first horizontal line HL1, but the pixels arranged along the second horizontal line HL2 at the same time.

In the OLED display according to the present disclosure, an emission control signal stage realized as one stage supplies an emission control signal to pixels arranged along a pair of horizontal lines, so it is possible to reduce the number of stages of the emission control signal stage that is configured to drive the entire display panel. As a result, a bezel area in which the emission control signal stage is disposed may be reduced.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode (OLED) display comprising:

a plurality of pixels arranged along n number of lines in a first direction where n is a natural number, each of the plurality of pixels comprising a first scan transistor connected to a gate electrode of a driving transistor, a second scan transistor connected to a first electrode of the driving transistor, and an emission control transistor connected to a second electrode of the driving transistor;

n number of first scan signal stages that output first scan signals sequentially to the first scan transistors arranged along the n number of lines;

n number of second scan signal stages that output second scan signals sequentially to the second scan transistors arranged along the n number of lines; and $$\frac{n}{2}$$

number of emission control signal stages that output emission control signals that have a same phase, a same emission control signal outputted to emission control transistors of two adjacent lines, and wherein the OLED display further comprises a j-th emission control signal stage outputting a j-th emission control signal where j is a natural number smaller than n, the j-th emission control stage comprising:

a pull-up transistor that outputs a high-potential voltage to an emission control signal output terminal responsive to a gate electrode of the pull-up transistor being charged;

a pull-down transistor that discharges a potential of the emission control signal output terminal to a low-potential voltage responsive to a gate electrode of the pull-down transistor being charged;

a first low-potential trigger transistor that charges the gate electrode of the pull-down transistor at the beginning of an initialization period of the OLED display; and a second low-potential trigger transistor that charges the gate electrode of the pull-down transistor in a data writing period of the OLED display, and wherein the j-th emission control signal is applied to pixels arranged along a j-th horizontal line and a (j+1)-th horizontal line.

2. The OLED display of claim 1, wherein for each of the plurality of pixels:

the first electrode of the driving transistor is connected to an OLED;

the first scan transistor comprises a gate electrode that receives a first scan signal, a first electrode connected to a data line, and a second electrode connected to the gate electrode of the driving transistor;

the second scan transistor comprises a gate electrode that receives a second scan signal, a first electrode connected to an initialization line, and a second electrode connected to the first electrode of the driving transistor and the OLED; and the emission control transistor comprises a gate electrode that receives the emission control signal, a first electrode connected to a voltage source, and a second electrode connected to the second electrode of the driving transistor.

3. The OLED display of claim 2, wherein during an initialization period of the OLED display:

the first scan transistor applies a reference voltage to the gate electrode of the driving transistor in response to the gate electrode of the first scan transistor receiving the first scan signal, and the second scan transistor applies an initialization voltage to the first electrode of the driving transistor in response to the gate electrode of the second scan transistor receiving the second scan signal.

4. The OLED display of claim 3, wherein during a sampling period of the OLED display:

the second scan transistor is turned off and the first electrode of the driving transistor floats responsive to the second scan transistor being turned off;

the first scan transistor applies the reference voltage to the gate electrode of the driving transistor in response to the gate electrode of the first scan transistor receiving the first scan signal; and the emission control transistor applies a current to the first electrode of the driving transistor in response to the gate electrode of the emission control transistor receiving the emission control signal, wherein a voltage of the first electrode of the driving transistor corresponds to a difference between the reference voltage and a threshold voltage of the driving transistor.

5. The OLED display of claim 4, wherein during a data writing period of the OLED display:

the second scan transistor and the emission control transistor are turned off; and the first scan transistor charges a storage capacitor that is connected between the gate electrode and the first electrode of the driving transistor in response to the gate electrode of the first scan transistor receiving the first scan signal, the storage capacitor charged to a data voltage received from the data line that is connected to the first electrode of the first scan transistor.

6. The OLED display of claim 5, wherein during an emission period of the OLED display:

the first scan transistor and the second scan transistor are turned off;

the emission transistor applies a current to the first electrode of the driving transistor and the OLED in response to the gate electrode of the emission control transistor receiving the emission control signal; and the storage capacitor applies the data voltage stored in the storage capacitor to the OLED and the OLED emits light responsive to the current.

7. The OLED display of claim 1, wherein the first low-potential trigger transistor comprises a first electrode receiving a j-th first scan signal, a second electrode connected to the gate electrode of the pull-down transistor, and a gate electrode connected to a clock signal input terminal which has a voltage level that turns on the first low-potential trigger transistor during the initialization period.

8. The OLED display of claim 1, wherein the second low-potential trigger transistor comprises a gate electrode receiving a (j+1)-th first scan signal, a first electrode connected to an emission reset input terminal which outputs a high level signal during the data writing period, and a second electrode connected to the gate electrode of the pull-down transistor and the second electrode of the first low-potential trigger transistor.

9. The OLED display of claim 8, wherein the (j+1)-th first scan signal is maintained at a voltage level that turns on the second low-potential trigger transistor in a data writing period for pixels arranged along the j-th horizontal line and in an initialization period for pixels arranged along the (j+1)-th horizontal line.

10. The OLED display of claim 1, further comprising:

a third low-potential trigger transistor comprising a first electrode connected to high-potential voltage input terminal, a second electrode connected to the gate electrode of the pull-down transistor and the second electrode of the first low-potential trigger transistor, and a gate electrode connected to a (j+1)-th second scan signal.

11. The OLED display of claim 10, wherein the (j+1)-th second scan signal is maintained at a voltage level that turns on the third low-potential trigger transistor in a part of an initialization period and in a part of an emission period for the pixels arranged along the j-th horizontal line.

12. The OLED display of claim 1, wherein the first scan signal stage outputs a j-th first scan signal at a voltage level that turns on the first scan transistor in a first initialization period and a second initialization period, a sampling period, and a data writing period for pixels arranged along a j-the horizontal line (j indicates a natural number smaller than n).

13. The OLED display of claim 12, wherein the n number of second scan signal stages output a j-th second scan signal at a voltage level that turns on the second scan transistor in the second initialization period for the pixels arranged along the j-th horizontal line.

14. The OLED display of claim 13, wherein the $$\frac{n}{2}$$

number of emission control signal stage outputs a j-th emission control signal at a voltage level that turns on the emission control transistor in the sampling period for the pixels arranged along the j-th horizontal line.

15. The OLED display of claim 14, wherein the j-th emission control signal is at a voltage level that turns off the emission control transistor in the second initialization period and the data writing period for the pixels arranged along the (j+1)-th horizontal line.

16. The OLED display of claim 14, wherein the j-th emission control signal stage generates the j-th emission control signal by receiving j-th first scan signal and the j-th second scan signals, and a (j+1)-th first scan signal.

17. An organic light emitting diode (OLED) display comprising:

a first row of pixels and a second row of pixels that is adjacent to the first row of pixels, each pixel comprising an OLED, a driving transistor connected to the OLED, and an emission control transistor connected to the driving transistor; and an emission control stage connected to both the first row of pixels and the second row of pixels, the emission control stage outputting an emission control signal to a gate electrode of each emission control transistor included in both the first row of pixels and the second row of pixels, and wherein the OLED display further comprises a j-th emission control stage outputting a j-th emission control signal where j is a natural number smaller than n, the j-th emission control stage comprising:

a pull-up transistor that outputs a high-potential voltage to an emission control signal output terminal responsive to a gate electrode of the pull-up transistor being charged;

a pull-down transistor that discharges a potential of the emission control signal output terminal to a low-potential voltage responsive to a gate electrode of the pull-down transistor being charged;

a first low-potential trigger transistor that charges the gate electrode of the pull-down transistor at the beginning of an initialization period of the OLED display; and a second low-potential trigger transistor that charges the gate electrode of the pull-down transistor in a data writing period of the OLED display, and wherein the j-th emission control signal is applied to pixels arranged along a j-th horizontal line and a (j+1)-th horizontal line.

18. The OLED of claim 17, wherein each of the plurality of pixels further comprises:

a first scan transistor connected to a gate electrode of the driving transistor;

a second scan transistor connected to a first electrode of the driving transistor; and wherein a first electrode of the emission control transistor is connected to a voltage source and a second electrode of the emission control transistor is connected to a second electrode of the driving transistor.

19. The OLED of claim 18, further comprising:

a plurality of first scan signal stages that sequentially output first scan signals to the first scan transistors included in the first row of pixels and the second row of pixels; and a plurality of second scan signal stages that sequentially output second scan signals to the second scan transistors included in the first row of pixels and the second row of pixels.

* * * * *